US007971987B2

(12) United States Patent
Godil et al.

(10) Patent No.: US 7,971,987 B2
(45) Date of Patent: Jul. 5, 2011

(54) HEATED DRUM ASSEMBLY HAVING INTEGRATED THERMAL SENSING FOR USE IN A PRINTER

(75) Inventors: Amin M. Godil, Beaverton, OR (US); Larry E. Hindman, Woodburn, OR (US); Isaac S. Frazier, Portland, OR (US); Walter Sean Harris, Portland, OR (US); William Bruce Weaver, Canby, OR (US)

(73) Assignee: Xerox Corporation, Norwalk, CT (US)

( * ) Notice: Subject to any disclaimer, the term of this patent is extended or adjusted under 35 U.S.C. 154(b) by 673 days.

(21) Appl. No.: 12/039,846

(22) Filed: Feb. 29, 2008

(65) Prior Publication Data

US 2009/0219328 A1 Sep. 3, 2009

(51) Int. Cl.
*B41J 2/01* (2006.01)

(52) U.S. Cl. ..... 347/103

(58) Field of Classification Search ..... 347/103
See application file for complete search history.

(56) References Cited

U.S. PATENT DOCUMENTS 5,499,089 A * 3/1996 Tsukamoto et al. ..... 399/328
5,682,580 A 10/1997 Iwama et al.
5,999,764 A 12/1999 Okabayashi et al.
6,011,935 A 1/2000 Matsuzaka et al.
6,029,040 A 2/2000 Yamada et al.
6,035,173 A 3/2000 Kagawa
6,137,983 A 10/2000 Okabayashi et al.
6,713,728 B1 3/2004 Justice et al.
6,979,800 B2 * 12/2005 Kohne et al. ..... 219/213
7,142,793 B1 11/2006 Potter et al.
2004/0060921 A1 * 4/2004 Justice et al. ..... 219/469
2007/0045295 A1 * 3/2007 Hays et al. ..... 219/647

* cited by examiner

*Primary Examiner* — Matthew Luu
*Assistant Examiner* — Rut Patel
(74) *Attorney, Agent, or Firm* — Maginot, Moore & Beck LLP

(57) ABSTRACT

A heated drum assembly enables improved thermal control of a hollow drum in the heated drum assembly by integrating thermal sensing devices in the assembly. The heated drum assembly includes a hollow drum having a circumferential wall that defines an outer boundary for an internal cavity, the hollow drum having a first end and a second end and a longitudinal axis about which the hollow drum rotates, a stationary heater that is located within the internal cavity of the hollow drum to heat the circumferential wall as it passes by the heater, the heater having a reflector with at least one wall and at least one heating element between the reflector and the circumferential wall of the hollow drum, the reflector and a portion of the circumferential wall subtended by the reflector forming a heating zone, an insulating shield mounted to the wall of the reflector, a thermal cutout mounted on the insulating shield, a support arm having a first end and a second end, the first end of the support arm being mounted to the insulating shield, and a thermal sensor mounted to the second end of the support arm.

19 Claims, 2 Drawing Sheets

HEATED DRUM ASSEMBLY HAVING INTEGRATED THERMAL SENSING FOR USE IN A PRINTER

TECHNICAL FIELD

The device and method described herein generally relate to printers that generate images onto media using marking materials, such as ink or toner. More specifically, the device and method relate to printers in which the image formed by the marking materials is applied onto an intermediate image receiving member.

BACKGROUND

Some printing systems use a heated drum or roller system to form an image on a target media, such as paper. In an offset solid ink printing process, a heated drum receives ink ejected from a printhead and transfers the image to media. These heated roller systems regulate the surface temperature of the roll to maintain the ink in a viscoelastic state. Ink in this state is better able to spread and penetrate into the target media during transfer. Such a process can improve the ultimate print quality by, for example, increasing solid fill density, decreasing ink layer thickness, and increasing the durability of the prints.

Previously known drum heaters used in solid ink-jet printers include external quartz halogen lamps that are mounted in reflector assemblies. More recently, an internal mica/wire based drum heater has been used for drum heating, as described in U.S. Patent Application US2007/0045295A1 issued to Hays et al. (hereinafter 'the 295 application'), and in U.S. Pat. No. 6,713,728 issued to Justice et al. (hereinafter 'the 728 patent'), the disclosures of which are expressly incorporated herein by reference in their entireties. The heater disclosed in the '295 application is more efficient because it includes an open-ended enclosure mounted about the heating elements of the heater so only a small gap exists between the perimeter of the enclosure face and the circumferential interior surface of the drum as it rotates past the heater. The structure of the heater in the '295 application helps reduce convective heat losses. Because the heating of the drum surface is more efficient, however, more accurate temperature control methods would be useful for optimum printing quality.

SUMMARY

A heated drum assembly enables improved thermal control of one or more heating elements in the heated drum assembly by integrating thermal sensing devices in the assembly. The heated drum assembly includes a hollow drum having a circumferential wall that defines an outer boundary for an internal cavity, the hollow drum having a longitudinal axis about which the hollow drum rotates, a stationary heater that is located within the internal cavity of the hollow drum to heat the circumferential wall as it passes by the heater, the heater having a reflector with at least one wall and at least one heating element between the reflector and the circumferential wall of the hollow drum, the reflector and a portion of the circumferential wall subtended by the reflector forming a heating zone, an insulating shield mounted to the wall of the reflector, a support arm having a first end and a second end, the first end of the support arm being mounted to the insulating shield, and a thermal cutout mounted to the second end of the support arm.

BRIEF DESCRIPTION OF THE DRAWINGS

Features of the present invention will become apparent to those skilled in the art from the following description with reference to the drawings, in which.

DETAILED DESCRIPTION

The term "printer" refers, for example, to reproduction devices in general, such as printers, facsimile machines, copiers, and related multi-function products. While the specification focuses on a heated drum assembly that regulates the heating of an intermediate image drum in a solid ink printer, the assembly may be used with any printer that uses another type of intermediate imaging surface, such as a belt, to assist in transferring the image to media.

Figure 1:
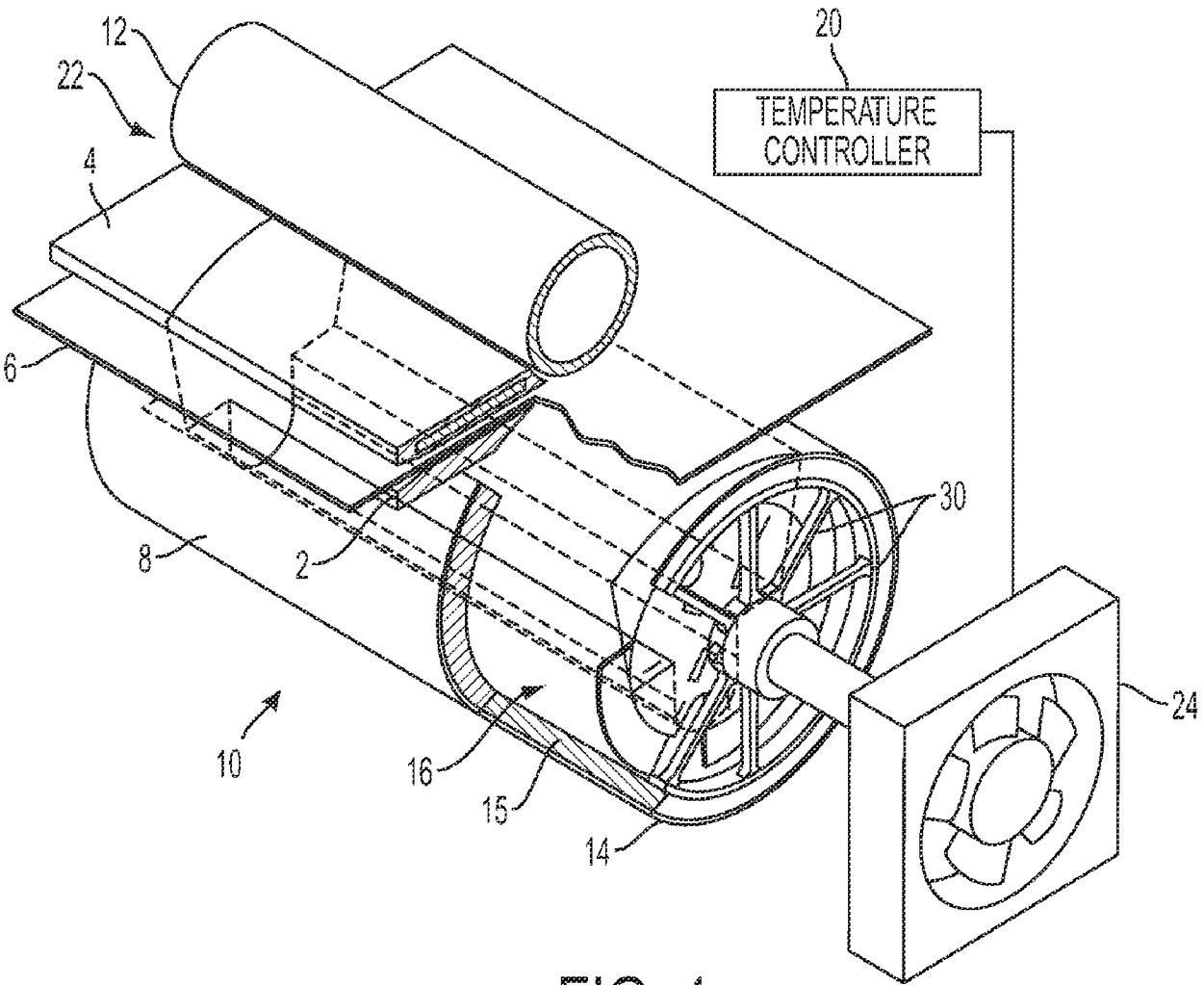
FIG. 1 is a perspective view of a drum assembly for a printer.

FIG. 1 is a diagram of a heated drum assembly 10 that cooperates with other components in a printer to transfer an image to a substrate. As shown in FIG. 1, a substrate guide 2 and a preheater plate 4 direct a substrate 6, such as a piece of paper, between them to a nip 22 formed between a transfer roller 12 and a heated intermediate imaging drum 14. A pattern on an intermediate transfer surface 8 of the drum 14 is transferred from the intermediate transfer surface 8 to the substrate 6 to form an image on the substrate 6. A heater 18 (FIG. 2) within the heated drum assembly 10 heats the intermediate transfer surface 8 of the drum 14 to maintain a temperature conducive to image formation and transfer during operation of the printing system. The hollow drum 14 has a circumferential wall 15 that defines an outer boundary for an internal cavity 16. The hollow drum 14 has a longitudinal axis 62 (FIG. 3) about which the hollow drum 14 rotates. Each end of the drum 14 is open to enable air flow through the drum. As described more fully below, the drum assembly 10 also includes a stationary heater that is located within the internal cavity 16 of the hollow drum 14 to heat the circumferential wall 15 as it passes by the heater.

Power supply lines to the heater 18 as well as thermal sensor signals from a sensor mounted in association with the heater 18 are coupled to the temperature controller 20. The temperature controller 20 uses temperature data from the thermal sensors to regulate the temperature of the drum 14. The controller 20 regulates the temperature of the drum assembly 10 by selectively operating a fan 24, which blows air past spokes 30 of the open end of the drum 14 to cool the internal cavity 16, and by selectively activating the heater 18, which heats the circumferential wall 15 of the drum 14 as it passes the heater.

Figure 2:
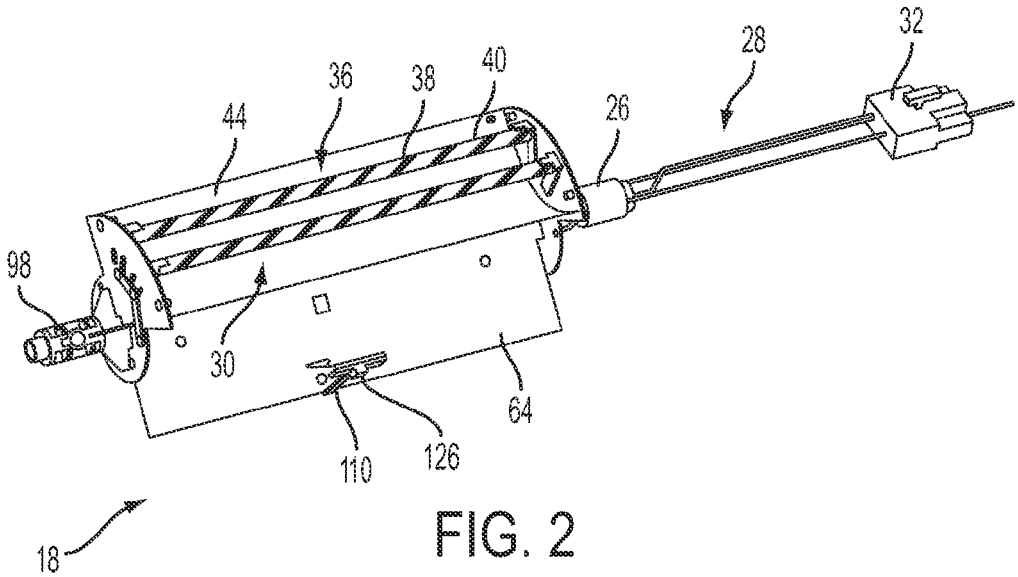
FIG. 2 is a front perspective view of a heater used within the drum of the assembly shown in FIG. 1.

Referring now to FIG. 2, a heater 18 includes a reflector 44 that is formed with at least one wall and at least one heating element 36 between the reflector 44 and the circumferential wall 15 of the hollow drum 14. The reflector 44 may be a single wall, as shown in FIG. 2, or it may include a plurality of walls that are joined together to form an enclosure about the heating elements 36. As shown in FIG. 2, the reflector 44 is a single wall that has been formed in the shape that approximates a parabola. This shape helps reflect heat from the heating elements 36, which are located near the focus of the parabola, towards the circumferential wall 15 of the drum 14. The reflector 44 may be made of thin reflective material and may be made of a metal, such as stainless steel, aluminum, or the like, for example. The reflector 44 and a portion of the circumferential wall 15 subtended by the reflector 44 form a heating zone. Some of the energy generated by a heating element 36 may be transferred directly to the drum 14 as radiant energy, while some of the energy may be transferred indirectly via convection.

The heating elements 36 shown in FIG. 2 may be comprised of resistive wire coils 38 and a support structure 40. The support structure 40 may be, for example, a quartz tube or rod, although any refractory material may be used. Alternatively, mica or another high temperature insulating structural material may be used as a support structure provided the temperature of the wire coils 38 remains below the service limit of the mica. The heating elements 36 do not have to include wire coils to generate heat nor do they have to be wrapped about the support structure 40. For example, wire coils or other radiant heating elements may be woven on a board as in a kitchen toaster or configured in any number of common ways to achieve the desired power and footprint. The heating elements 36 may be, for example, 150 W heating elements selectively operable at 120 Volts and 240 Volts. The length of the heating elements 36 may enable the heating elements to fit within the length of the drum 14. By way of example, a heating element 36 may include a mica support tube with an outer diameter of 6.1 mm and wire coils 38, which may be fabricated out of Kanthal AF or Nichrome 80, may be wrapped around the tube. The heater 18 may include one or more heating elements that have been constructed as described above. In the embodiment shown in FIG. 2, two heating elements 36 are provided for purposes of the description. While the heating elements shown in the figure are oriented to be parallel to the internal surface of the circumferential wall 15, they may also be angled to compensate for thermal gradients that may be unique to a given application.

Wires 28 from the heating elements 36 and from the thermal sensors integrated into the heater 18, which are discussed more fully below, extend through mounting collar 26 to the plug 32. Plug 32 enables terminals within the plug to couple the heating elements to electrical power through control components that are operated by the temperature controller 20. Also, terminals within the plug 32 couple the electrical signals from the temperature measuring devices in the heater 18 to the temperature controller 20. The thermal data from these devices enable the controller 20 to regulate the operation of the fan 24 and the application of power to the heater with more accurate and stable data than previously known. The mounting collar 26 and the bearing pin 98 fit within receptacles of the drum assembly 10 to install the heater 18 within the drum 14 in a stationary fashion. Thus, the drum 14 rotates past the stationary heater 18 to enable the radiant heat from the heating elements 18 and the convective heat from the heated air within the heating zone to raise the temperature of the circumferential wall 15.

Figure 3:
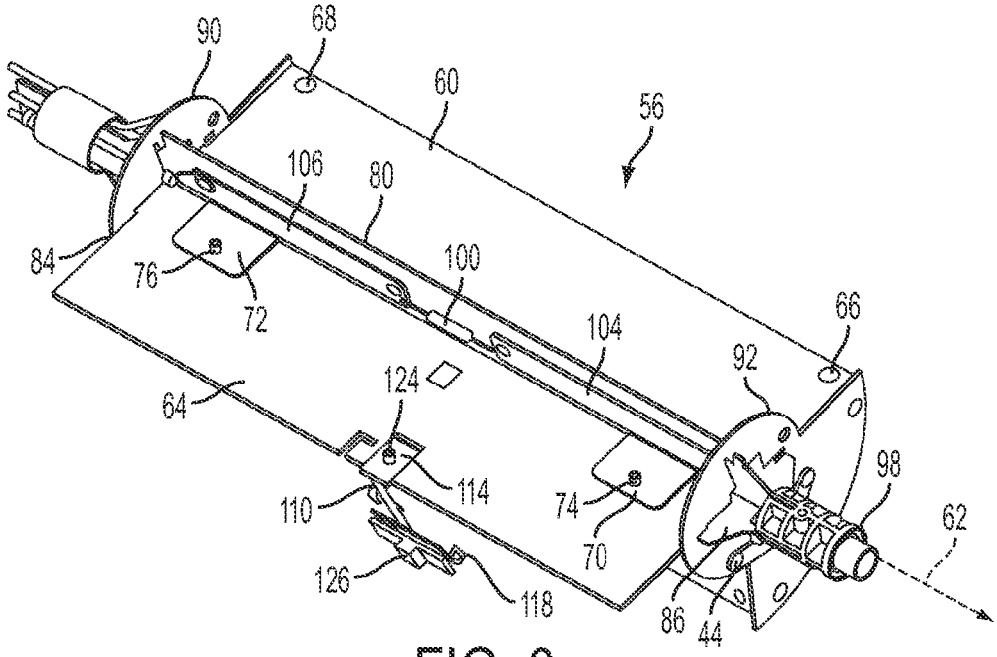
FIG. 3 is rear perspective view of the heater of FIG. 2.

Referring now to FIG. 3, an insulating shield 56 is mounted behind the reflector 44. The shield 56 may be made of one or more sheets or plates of mica or other insulating material. As shown in FIG. 3, the insulating shield 56 includes plate 60 and plate 64. Plate 60 is mounted to a portion of the parabolic reflector 44 by screws 66 and 68. Plate 60 includes tabs 70 and 72 to provide a portion that overlaps plate 64. Screws or rivets 74 and 76 are used to mount plate 64 to the tabs 70 and 72. A flange 80 may also be provided along the longitudinal axis 62 of the heater 18. Ends 84 and 86 fit within slots of the collars 90 and 92. The lower portion of end 86 may terminate into a tab that is secured within the bearing pin 98. A thermal monitoring device 100 is positioned on the insulating shield 56 that is opposite the heat zone. This positioning enables the thermal monitor to more accurately sense temperature within the drum without being affected by the convective or radiant heat energy produced by the heater elements. The thermal monitoring device 100 is electrically coupled between two conductors 104 and 106 to form a portion of the electrical circuit that supplies power to the heater 18. The thermal monitoring device 100 may be a thermal cutout, which is an electrical switch that opens in response to a temperature reaching a predetermined temperature. That is, the device remains electrically closed to enable power to be delivered to the heating elements 36 as long as the temperature sensed by the thermal cutout remains below the predetermined temperature at which the contacts in the thermal cutout open. In response to a temperature being sensed by the thermal cutout that is greater than the predetermined cutout, the electrical contacts in the thermal cutout open and power can no longer be delivered to the heating elements. Thus, the thermal cutout decouples the heater 18 from electrical power in response to the temperature of the insulating shield 56 reaching or exceeding the predetermined temperature to help protect the drum from damage arising from overheating.

Mounted to an edge of plate 64 that is outboard of the plate 60 that is backing the reflector 44 is a support arm 110 having a mounting flange 114 at one end and a support bracket 118 at the other end of the support arm. A screw 124 secures the mounting flange 114 to the plate 64 to extend the other end of the support arm in a plane that is perpendicular to the plane of the insulating shield 56. This extension terminates at a distance that places the support bracket proximate the circumferential wall 15 when the heated drum assembly is mounted within the drum 14. Mounted within the support bracket 118 is a temperature measuring device 126. When mounted within the drum 14, the temperature measuring device 126 is located on the side of the heating zone from which the circumferential wall 15 exits as wall rotates past the heater and towards the device 126. Thus, the temperature measuring device 126 measures the temperature of the circumferential wall 15 after it has been heated by the heater 18. In other embodiments, the temperature measuring device 126 may be mounted to the plate 60 so the circumferential wall 15 may be sensed before the wall enters the heating zone. In another embodiment, temperature measuring devices may be provided on both the plate 60 and 64.

The temperature measuring device 126 generates a temperature signal that is electrically coupled to the temperature controller. In response to the temperature signal, the temperature controller 20 may operate the fan 24 to reduce the temperature within the internal cavity 16 of the drum 14 and to disable operation of the fan 24 in response to the temperature signal indicating the temperature within the drum 14 is within an operating range. The temperature controller 20 also responds to the temperature measurement signal from the device 126 by adjusting the power delivered to the heater elements. The temperature measuring device 126 may be any suitable direct contact temperature measuring device, such as a thermocouple, a thermometer, a resistance temperature detector, a bimetallic thermometer, a semiconductor temperature sensor, or a radiation temperature measuring device, such as a pyrometer, a line-measuring thermometer, and an infrared radiation thermometer. In one embodiment, the temperature measuring device is a thermistor, which changes resistance in response to temperature changes.

Placing the thermistor on the surface of the insulating shield that is opposite the heating zone aids in monitoring the temperature within the cooler portion of the internal cavity 16 of the drum 14 that is not within the heating zone. Locating the support arm 110 near the midpoint of the length of the edge of the plate 64 enables the temperature measuring device 126 to sense the temperature of the circumferential wall in a more central location. Previous known systems required the temperature measuring device to be located on the structures at one of the ends of the drum. Placement nearer one of the drum edges causes the temperature measurements to be influenced by heat losses occurring at the ends of the drum. Temperature variability caused by temperature offsets and longer thermal collection cycles is also greater at the drum ends. Placement of the temperature measuring device in a central location allows accurate drum temperature control with corresponding improvement to print quality.

Another advantage of an internal drum thermistor inboard of the drum ends is that it offers the opportunity to reduce the drum length/mass and cost. This reduction arises from the structure that enables the temperature measuring device to be placed within the drum and near the center of the drum's length. Previously known drum heaters required any device for measuring the drum surface temperature to be mounted outside the drum. Because the imaging area is located on the exterior surface of the drum, the temperature measuring device had to be mounted outboard of the imaging area lest the device interfere with image area surface preparation and ink application. Thus, the length of the drum needed to be increased to provide a drum surface area for temperature measurements. The insulating shield and compact arrangement of the heater components described above enable the temperature measuring device to be placed within the drum interior near the center of the drum length. Therefore, the additional exterior surface area is no longer required for temperature measurements so the drum length can be reduced with a commensurate drop in material costs.

In operation, a thermal cutout and temperature sensing device are integrated in the structure of heater as described above. The heater is then mounted in the interior of an imaging drum. The power supply of the printer is electrically coupled to the heater and fan and the temperature measuring device is coupled to the controller. When the printer is put into operation, the controller receives the temperature measurement signal from the temperature measuring device and compares the signal to programmed setpoints for operating the fan and for supplying power to the heater elements. In the event of a fault condition, such as loss of a temperature measurement signal or processor failure, the thermal cutout provides a safety measure for helping ensure the drum is not damaged by overheating.

Variations and modifications of the present invention are possible, given the above description. However, all variations and modifications which are obvious to those skilled in the art to which the present invention pertains are considered to be within the scope of the protection granted by this Letters Patent.

What is claimed is:

1. A heated drum assembly for use in a printer, the drum assembly comprising:

a hollow drum having a circumferential wall that defines an outer boundary for an internal cavity, the hollow drum having a first end and a second end and a longitudinal axis about which the hollow drum rotates;

a stationary heater that is located within the internal cavity of the hollow drum to heat the circumferential wall as it passes by the heater, the heater having a reflector with at least one wall and at least one heating element between the reflector and the circumferential wall of the hollow drum; and a temperature measuring device coupled to the stationary heater, the temperature measuring device being positioned within the hollow drum proximate the circumferential wall of the hollow drum.

2. The drum assembly of claim 1, wherein the reflector has a parabolic shape; and the heating element is located on a focus side of the parabolic shape.

3. The drum assembly of claim 1 wherein the temperature measuring device is a thermistor.

4. The heated drum assembly of claim 1, wherein the heating element is oriented parallel to an internal surface of the circumferential wall.

5. A heated drum assembly for use in a printer comprising:

a hollow drum having a circumferential wall that defines an outer boundary for an internal cavity, the hollow drum having a first end and a second end and a longitudinal axis about which the hollow drum rotates;

a stationary heater that is located within the internal cavity of the hollow drum to heat the circumferential wall as the circumferential wall passes by the heater, the heater having a reflector with an insulating shield mounted to a wall of the reflector and at least one heating element positioned between the reflector and the circumferential wall of the hollow drum;

a support arm coupled to the wall of the reflector; and a thermistor coupled to the stationary heater, the thermistor being mounted to the support arm at a location that positions the thermistor within the hollow drum proximate the circumferential wall of the hollow drum.

6. The drum assembly of claim 5, wherein the support is an arm having two ends, one end of the arm being coupled to the insulating shield and the thermistor is mounted to the other end of the arm.

7. The heated drum assembly of claim 6, wherein the support arm is mounted to the insulating shield at a position that is approximately equidistant from the first and the second ends of the hollow drum.

8. The heated drum assembly of claim 5 further comprising:

a thermal monitoring device is located adjacent to the insulating shield, the insulating shield being between the thermal monitoring device and the reflector.

9. The heated drum assembly of claim 8 wherein the thermal monitoring device is a thermal cutout.

10. A heated drum assembly for use in a printer, the drum assembly comprising:

a hollow drum having a circumferential wall that defines an outer boundary for an internal cavity, the hollow drum having a first end and a second end and a longitudinal axis about which the hollow drum rotates;

a stationary heater that is located within the internal cavity of the hollow drum to heat the circumferential wall as it passes by the heater, the heater having a reflector with at least one wall and at least one heating element between the reflector and the circumferential wall of the hollow drum, the reflector and a portion of the circumferential wall subtended by the reflector forming a heating zone;

an insulating shield mounted to the wall of the reflector;

a support arm having a first end and a second end, the first end being mounted to the insulating shield; and a temperature measuring device mounted to the second end of the support arm to position the temperature measuring device within the hollow drum.

11. The heated drum assembly of claim 10, the support arm extending from the first end at a distance that places the temperature measuring device proximate the circumferential wall of the hollow drum.

12. The heated drum assembly of claim 11, the support arm extending from the first end in a direction that places the temperature measuring device proximate one side of the heating zone to sense a portion of the circumferentially wall thermally before the sensed portion enters the heating zone.

13. The heated drum assembly of claim 11, the support arm extending from the first end in a direction that places the temperature measuring device proximate one side of the heating zone to sense a portion of the circumferentially wall thermally after the sensed portion exits the heating zone.

14. The drum assembly of claim 10, wherein the reflector has a parabolic shape; and the heating element is located on a focus side of the parabolic shape.

15. The heated drum assembly of claim 10 wherein the support arm is mounted to the insulating shield approximately equidistant from the first and the second ends of the hollow drum.

16. The heated drum assembly of claim 10, wherein the heating element is oriented parallel to an internal surface of the circumferential wall.

17. The heated drum assembly of claim 10 further comprising:

a thermal monitoring device proximate the insulating shield, the insulating shield being between the thermal monitoring device and the heating element.

18. The heated drum assembly of claim 17 wherein the thermal monitoring device is a thermal cutout.

19. The heated drum assembly of claim 10 wherein the temperature measuring device is a thermistor.

* * * * *